US010082141B2

(12) United States Patent
Iwano et al.

(10) Patent No.: US 10,082,141 B2
(45) Date of Patent: Sep. 25, 2018

(54) SCROLL-TYPE FLUID MACHINE

(71) Applicant: Hitachi Industrial Equipment Systems Co., Ltd., Chiyoda-ku, Tokyo (JP)

(72) Inventors: Kiminori Iwano, Tokyo (JP); Kazutaka Suefuji, Tokyo (JP); Yoshio Kobayashi, Tokyo (JP); Toshikazu Harashima, Tokyo (JP); Kosuke Sadakata, Tokyo (JP); Koichi Tashiro, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 264 days.

(21) Appl. No.: 14/760,540

(22) PCT Filed: Dec. 16, 2013

(86) PCT No.: PCT/JP2013/083546
§ 371 (c)(1),
(2) Date: Jul. 13, 2015

(87) PCT Pub. No.: WO2014/132526
PCT Pub. Date: Sep. 4, 2014

(65) Prior Publication Data

US 2015/0337834 A1 Nov. 26, 2015

(30) Foreign Application Priority Data

Feb. 27, 2013 (JP) ..... 2013-036583

(51) Int. Cl.
*F04C 18/02* (2006.01)
*F04C 29/00* (2006.01)
(Continued)

(52) U.S. Cl.
CPC ..... *F04C 18/0253* (2013.01); *F01C 1/0215* (2013.01); *F01C 1/0253* (2013.01);
(Continued)

(58) Field of Classification Search
CPC ..... F01C 17/06; F01C 17/063; F01C 17/066; F01C 1/0215; F01C 21/06; F01C 21/10;
(Continued)

(56) References Cited

U.S. PATENT DOCUMENTS 5,253,989 A * 10/1993 Shindo ..... F01C 1/0246 418/55.2
5,755,564 A * 5/1998 Machida ..... F01C 17/06 418/101
(Continued)

FOREIGN PATENT DOCUMENTS

JP 62-78494 A 4/1987
JP S6278494 A * 4/1987
(Continued)

OTHER PUBLICATIONS

Extended European Search Report issued in counterpart European Application No. 13876338.8 dated Sep. 20, 2016 (8 pages).
(Continued)

*Primary Examiner* — Mark Laurenzi
*Assistant Examiner* — Xiaoting Hu
(74) *Attorney, Agent, or Firm* — Crowell & Moring LLP

(57) ABSTRACT

The objective of the present invention is to provide a scroll-type fluid machine for which the service life can be improved by reducing the load applied to a rotation prevention mechanism. To solve this problem, this scroll-type fluid machine is characterized by being equipped with a stationary scroll, an orbiting scroll that is provided opposing the stationary scroll and undergoes turning movement, a casing provided on the outside of the orbiting scroll, a drive shaft that drives and turns the orbiting scroll, a boss plate part that is provided separated from the orbiting scroll and is connected to the drive shaft, and multiple rotation prevention mechanisms provided between the boss plate part and the
(Continued)

casing, and is characterized in that the boss plate part has multiple rotation-prevention-mechanism-side boss plate parts connected to the rotation prevention mechanisms, and a drive-shaft-side boss plate part connected to the drive shaft, and spaces are provided between the rotation-prevention-mechanism-side boss plate parts and the drive-shaft-side boss plate part.

14 Claims, 4 Drawing Sheets

(51) Int. Cl.

| | |
|---|---|
| ***F01C 1/02*** | (2006.01) |
| ***F01C 17/06*** | (2006.01) |
| ***F04C 2/02*** | (2006.01) |
| ***F04C 15/00*** | (2006.01) |
| ***F01C 21/10*** | (2006.01) |
| ***F04C 29/04*** | (2006.01) |

(52) U.S. Cl.
CPC ..... *F01C 17/06* (2013.01); *F01C 17/063* (2013.01); *F01C 21/10* (2013.01); *F04C 2/025* (2013.01); *F04C 15/0061* (2013.01); *F04C 15/0065* (2013.01); *F04C 18/0215* (2013.01); *F04C 29/005* (2013.01); *F04C 29/0057* (2013.01); *F04C 29/04* (2013.01)

(58) Field of Classification Search
CPC .... F01C 1/0253; F04C 2/025; F04C 15/0065; F04C 18/0215; F04C 18/0253; F04C 29/005; F04C 29/0057; F04C 29/0078; F04C 15/0061; F04C 15/0076
USPC ..... 418/55.1, 55.2, 55.3
See application file for complete search history.

(56) References Cited

U.S. PATENT DOCUMENTS

| | | | | |
|---|---|---|---|---|
| 8,328,545 | B2 * | 12/2012 | Kobayashi | F01C 17/063 418/55.3 |
| 2003/0053922 | A1 * | 3/2003 | Satoh | F04C 29/04 418/55.1 |
| 2006/0067847 | A1 * | 3/2006 | Unami | F01C 1/0223 418/55.3 |

FOREIGN PATENT DOCUMENTS

| | | | |
|---|---|---|---|
| JP | 5-1502 | A | 1/1993 |
| JP | 7-119672 | A | 5/1995 |
| JP | 9-32761 | A | 2/1997 |
| JP | 9-53589 | A | 2/1997 |
| JP | 9-228966 | | 9/1997 |
| JP | 2000-205156 | A | 7/2000 |
| JP | 2003-65267 | A | 3/2003 |
| JP | 2003-65271 | A | 3/2003 |
| JP | 2010-84592 | A | 4/2010 |

OTHER PUBLICATIONS

International Search Report (PCT/ISA/210) dated Mar. 18, 2014 with English-language translation (three (3) pages).

* cited by examiner

SCROLL-TYPE FLUID MACHINE

TECHNICAL FIELD

The present invention relates to a scroll-type fluid machine.

BACKGROUND ART

As a background art of the present invention, in Patent Literature 1, a scroll fluid machine is described in which a crank type rotation prevention mechanism that prevents an orbiting scroll from rotating with respect to a stationary scroll is provided in an end plate of the orbiting scroll, and an elastic body is provided in a gap between the crank type rotation prevention mechanism and the end plate.

Also, in Patent Literature 2, a scroll-type fluid machine is described in which stays are provided which can be elatically deformed in the radial direction in bearing housings that retain orbiting side bearings of a support plate provided on the back surface side of an end plate of an orbiting scroll.

Further, in Patent Literature 3, an oil-free scroll fluid machine is described in which a connection plate is provided so as to oppose an end plate of an orbiting scroll, and communication ports that become flow passages of cooling air are provided in the connection plate.

CITATION LIST

Patent Literature

Patent Literature 1: JP-A-S62-078494
Patent Literature 2: JP-A-H09-228966
Patent Literature 3: JP-A-2003-065267

SUMMARY OF INVENTION

Technical Problem

In a scroll-type fluid machine, a rotation prevention mechanism preventing rotation of an orbiting scroll is provided between the orbiting scroll and a casing. The orbiting scroll thermally expands greatly by compression heat, whereas the casing does not thermally expand greatly as the orbiting scroll does. Therefore, an excessive load was applied to the rotation prevention mechanism because of the thermal expansion difference between the both.

In the scroll fluid machine described in Patent Literature 1, the crank type rotation prevention mechanism is attached directly to the end plate of the orbiting scroll. Therefore, the thermal expansion difference between the orbiting scroll and the casing was large, and it was not sufficient for reduction of the load applied to the rotation prevention mechanism only to arrange the elastic body in the gap between the crank type rotation prevention mechanism and the end plate.

In the scroll-type fluid machine described in Patent Literature 2, the rotation prevention mechanisms (auxiliary cranks) are not attached directly to the end plate of the orbiting scroll, but are arranged in the support plate that is separate from the orbiting scroll. Therefore, because the support plate thermally expands less than the orbiting scroll does, a load applied to the rotation prevention mechanisms (auxiliary cranks) is reduced compared with Patent Literature 1. However, even in that case, the thermal expansion difference between the support plate and the casing was not sufficiently small, and it was necessary to further reduce the load applied to the rotation prevention mechanisms (auxiliary cranks)

In the structure of Patent Literature 2, because the stays and the support plate contacted each other, the thermal expansion difference between the support plate and the casing could not be absorbed sufficiently by the friction resistance of the contact surface. Also, the center (a portion where the drive shaft is located) of the support plate and the rotation prevention mechanisms (auxiliary cranks) were connected to each other in the radial direction, and the support plate could not sufficiently absorb the thermal expansion difference between the orbiting scroll and the casing when the thermal expansion difference was generated between the support plate and the casing. Therefore, the load applied to the rotation prevention mechanisms could not be reduced.

Also in the oil-free scroll fluid machine described in Patent Literature 3, similarly to that of Patent Literature 2, the rotation prevention mechanisms are provided between the connection plate that is separate from the orbiting scroll and the casing. However, although the communication ports are provided in the connection plate, the center (a portion where the drive shaft is located) of the connection plate and the rotation prevention mechanism are connected to each other in the radial direction. Therefore, when the thermal expansion difference was generated between the connection plate and the casing, the portion of the connection plate where the rotation prevention mechanisms were located could not be elastically deformed to the center side, and the load applied to the rotation prevention mechanisms could not be reduced.

In view of the problems described above, the object of the present invention is to provide a scroll-type fluid machine capable of extending the service life by reducing the load applied to the rotation prevention mechanisms.

Solution to Problem

In order to solve the problems described above, the present invention provides a scroll-type fluid machine including a stationary scroll, an orbiting scroll that is provided opposing the stationary scroll and undergoes turning movement, a casing provided on the outside of the orbiting scroll, a drive shaft that drives and turns the orbiting scroll, a boss plate part that is provided separated from the orbiting scroll and is connected to the drive shaft, and multiple rotation prevention mechanisms provided between the boss plate part and the casing, in which the boss plate part includes multiple rotation prevention mechanism-side boss plate parts connected to the rotation prevention mechanisms and a drive shaft-side boss plate part connected to the drive shaft, and spaces are provided between the rotation prevention mechanism-side boss plate parts and the drive shaft-side boss plate part.

Advantageous Effect of Invention

According to the present invention, it is possible to provide a scroll-type fluid machine capable of extending the service life by reducing the load applied to the rotation prevention mechanisms.

DESCRIPTION OF EMBODIMENTS

A scroll-type compressor as an embodiment of a scroll-type fluid machine of the present invention will be described based on FIG. 1 to FIG. 5.

Figure 1:
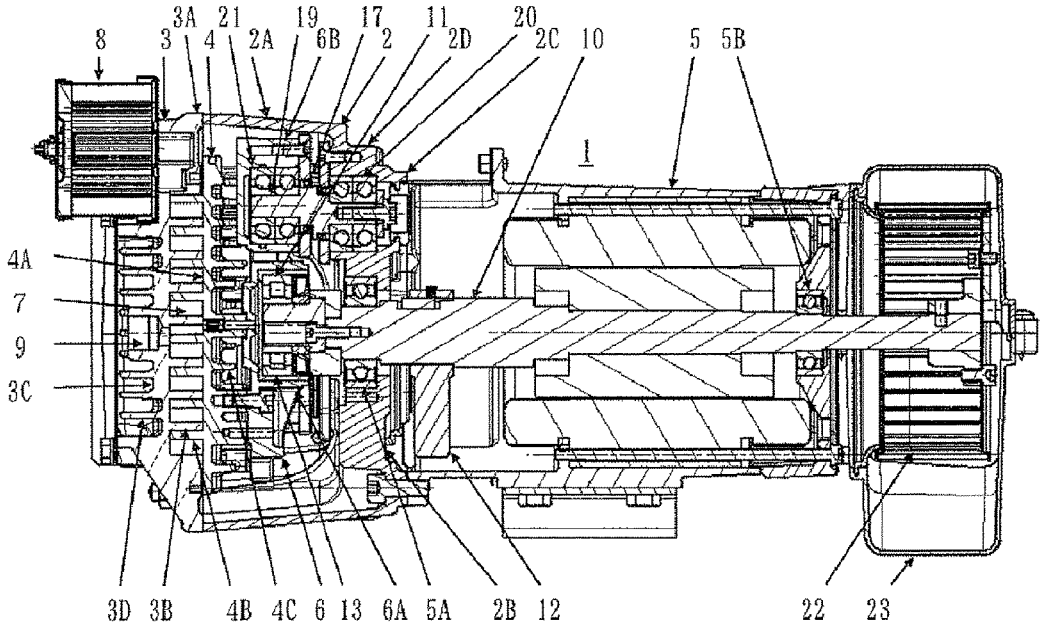
FIG. 1 is a vertical sectional view of an oil-free scroll compressor according to an embodiment of the present invention.

FIG. 1 is a vertical sectional view of a scroll-type compressor according to the present embodiment.

Compressor body 1 employs a scroll-type air compressor, and is formed of casing 2, stationary scroll 3, orbiting scroll 4, drive shaft 10, crank part 11, rotation prevention mechanisms 17, and the like described below.

Casing 2 forms an outer shell of compressor body 1, and is formed into bottomed cylindrical shape in which one side in the axial direction is closed and the other side in the axial direction is opened as shown in FIG. 1. To be more specific, casing 2 is generally formed of cylindrical part 2A whose other side in the axial direction (the side of stationary scroll 3 described below) is opened, annular bottom part 2B formed so as to be integral with one side in the axial direction of cylindrical part 2A and extending inward in the radial direction, and cylindrical attaching part 2C for motor 5 projecting toward both sides in the axial direction from the inner peripheral side of bottom part 2B.

Also, inside cylindrical part 2A of casing 2, orbiting scroll 4, crank part 11, rotation prevention mechanisms 17, and the like described below are stored.

Stationary scroll 3 as one scroll member is provided so as to be fixed on the open end side of casing 2 (cylindrical part 2A). Stationary scroll 3 is generally formed of end plate 3A formed into a disk shape, lap part 3B of a spiral shape erected on the surface of end plate 3A, support part 3C of a cylindrical shape provided on the outer peripheral side of end plate 3A so as to surround lap part 3B from the outside in the radial direction and fixed to the open end side of casing 2 (cylindrical part 2A) by multiple bolts (not illustrated) and the like, and cooling fins 3D disposed on the opposite side of lap part 3B with end plate 3A in between.

Orbiting scroll 4 forming the other scroll member is rotatably provided within casing 2 so as to oppose stationary scroll 3 in the axial direction. Also, as shown in FIG. 1, orbiting scroll 4 is generally formed of end plate 4A of a disk shape, lap part 4B erected on the surface of end plate 4A, multiple cooling fins 4C erected on the opposite side of lap part 4B, and boss plate part 6 of a cylindrical shape projectingly provided on the back surface (the surface opposite to lap part 4B) side of end plate 4A and attached to crank part 11 described below through turning bearing 13.

Motor 5 provided behind the compressor rotates drive shaft 10 that is rotatably supported by two bearings 5A, 5B.

Boss plate part 6 of orbiting scroll 4 is provided between orbiting scroll 4 and crank part 11 so as to be separate from orbiting scroll 4. The center of boss plate part 6 is disposed so as to be eccentric in the radial direction by a specific dimension (turning radius) determined beforehand with respect to the center of stationary scroll 3.

Multiple compression chambers 7 defined so as to overlap each other between lap part 3B of stationary scroll 3 and lap part 4B of orbiting scroll 4 are respectively formed between these lap parts 3B, 4B so as to be sandwiched by end plates 3A, 4A.

Suction port 8 provided on the outer peripheral side of stationary scroll 3 is for sucking air from the outside through intake filter 8A and the like for example. The air sucked by suction port 8 is continuously compressed within the respective compression chambers 7 accompanying the turning motion of orbiting scroll 4.

Discharge port 9 provided on the center side of stationary scroll 3 is for discharging compressed air toward the side of a storage tank (not illustrated) described below from compression chamber 7 located on the innermost diameter side out of the multiple compression chambers 7.

Drive shaft 10 rotatably provided through bearings 5A, 5B of motor 5 is rotatively driven by motor 5 that is detachably connected to casing 2. Also, to the distal end side (the other side in the axial direction) of drive shaft 10, boss part 4C of orbiting scroll 4 is turnably attached through crank part 11 and turning bearing 13 described below. On drive shaft 10, balance weight 12 is provided in order to stabilize the turning motion of orbiting scroll 4, and rotates integrally with drive shaft 10 at the time of operating the compressor.

Crank part 11 of drive shaft 10 arranged so as to be integral with the distal end side of drive shaft 10 is connected to boss plate part 6 of orbiting scroll 4 through turning bearing 13 that is stored in bearing boss 6A. Also, crank part 11 rotates integrally with drive shaft 10. Rotation of this time is converted to the turning motion of orbiting scroll 4 through turning bearing 13.

Orbiting scroll 4 is driven by motor 5 through drive shaft 10 and crank part 11, and performs a turning motion with respect to stationary scroll 3 in a state rotation is restricted by rotation prevention mechanisms 17 described below.

Thus, compression chamber 7 on the outside diameter side out of the multiple compression chambers 7 sucks air from suction port 8 of stationary scroll 3, and this air is compressed continuously within the respective compression chambers 7. Also, compression chamber 7 on the inside diameter side discharges compressed air toward the outside from the discharge port 9 located on the center side of end plate 3A.

Turning bearing 13 disposed between boss plate part 6 of orbiting scroll 4 and crank part 11 supports boss part 4C of orbiting scroll 4 so as to be turnable with respect to crank part 11. Turning bearing 13 compensates the turning motion of orbiting scroll 4 with respect to the axis of drive shaft 10 with a predetermined turning radius.

On the outside diameter side of boss plate part 6, rotation prevention mechanisms 17 (only one piece is illustrated in FIG. 1) are disposed between bottom part 2B of casing 2 at a predetermined interval in the peripheral direction of orbiting scroll 4. Rotation prevention mechanisms 17 are for preventing rotation of orbiting scroll 4 and for making bottom part 2B side of casing 2 receive the thrust load from orbiting scroll 4. The rotation prevention mechanism 17 is formed of an auxiliary crank 19 and auxiliary crank bearings 20, 21 of each of casing 2 side and orbiting scroll 4 side for example. Also, auxiliary crank bearings 20, 21 are stored in bearing bosses 2D, 6B provided in each of casing 2 and boss plate part 6.

Cooling fan 22 attached to the rear end of drive shaft 10 generates a cooling wind by rotation along with drive shaft 10. The cooling wind is guided to cooling fins 3D, 4C of each of stationary scroll 3 and orbiting scroll 4 by wind guide duct 23, passes through the gap between the fins and casing 2 side of boss plate part 6, and cools each portion whose temperature becomes high by the compression heat.

Figure 2:
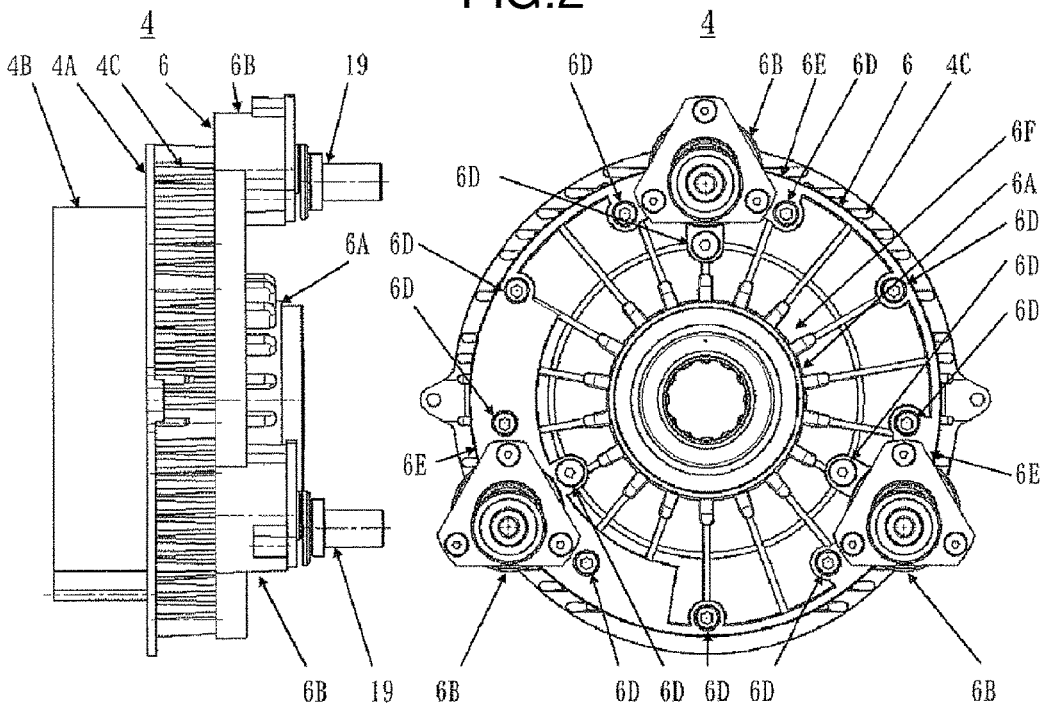
FIG. 2 is a configuration drawing of an orbiting scroll of a structure of a prior art.

FIG. 2 shows orbiting scroll 4 and boss plate part 6 of a structure of a prior art. At the time of compression operation, orbiting scroll 4 thermally expands greater than casing 2 does by the heat generated in compression chamber 7. Thus, a dimension difference is generated between the distance of bearing boss 6A provided by plurality in boss plate part 6 of orbiting scroll 4 from the center of end plate 3A and the distance of bearing boss 2D provided by plurality in casing 2 from the center of casing 2. Also, boss plate part 6 and most portions of the distal ends of cooling fins 4C of orbiting scroll 4 contact each other, and are securely fixed by multiple fastening bolts 6D. Therefore, the heat generated in compression chamber 7 is easily transmitted from orbiting scroll 4 to boss plate part 6, and the entire boss plate part 6 thermally expands greatly. Also, because fastening bolts 6D are located in the vicinity of bearing boss 6B of the auxiliary crank bearing 21, when end plate 4A of orbiting scroll 4 deforms, boss plate part 6 is also deformed integrally, and therefore the dimension difference described above between the distance of bearing boss 6A from the center of end plate 3A and the distance of bearing boss 2D from the center of casing 2 further increases. Furthermore, the cooling wind hardly hits the bearing boss on the downstream side of the cooling wind, the temperature rises further, and the dimension difference between the distance of bearing boss 6A from the center of end plate 3A and the distance of bearing boss 2D from the center of casing 2 is generated. From the above, it is configured that an excessive load is applied to rotation prevention mechanisms 17 and auxiliary crank bearings 20, 21 located between bearing boss 2D and bearing boss 6B.

Figure 3:
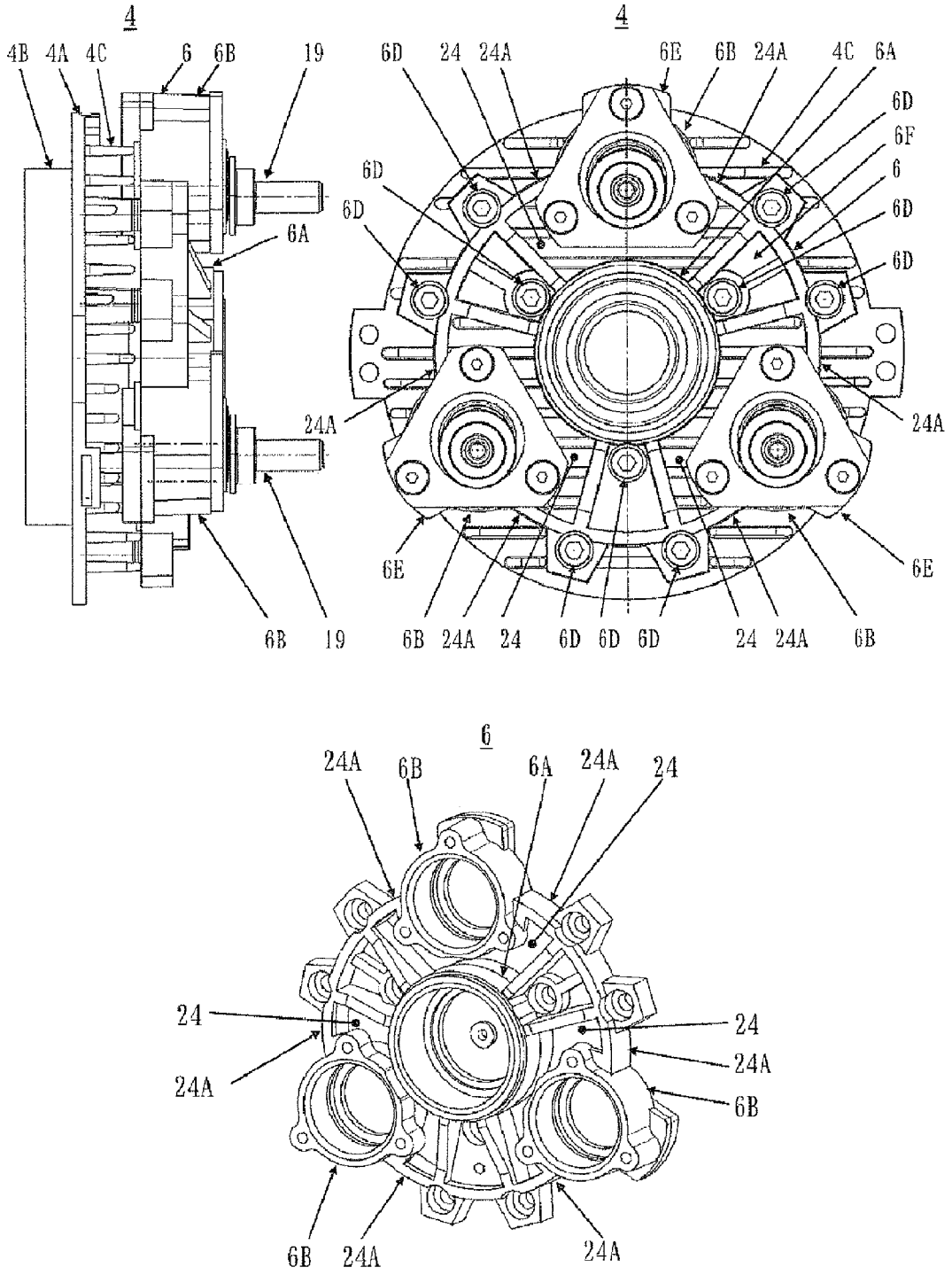
FIG. 3 is a configuration drawing of an orbiting scroll according to an embodiment of the present invention.
Figure 4:
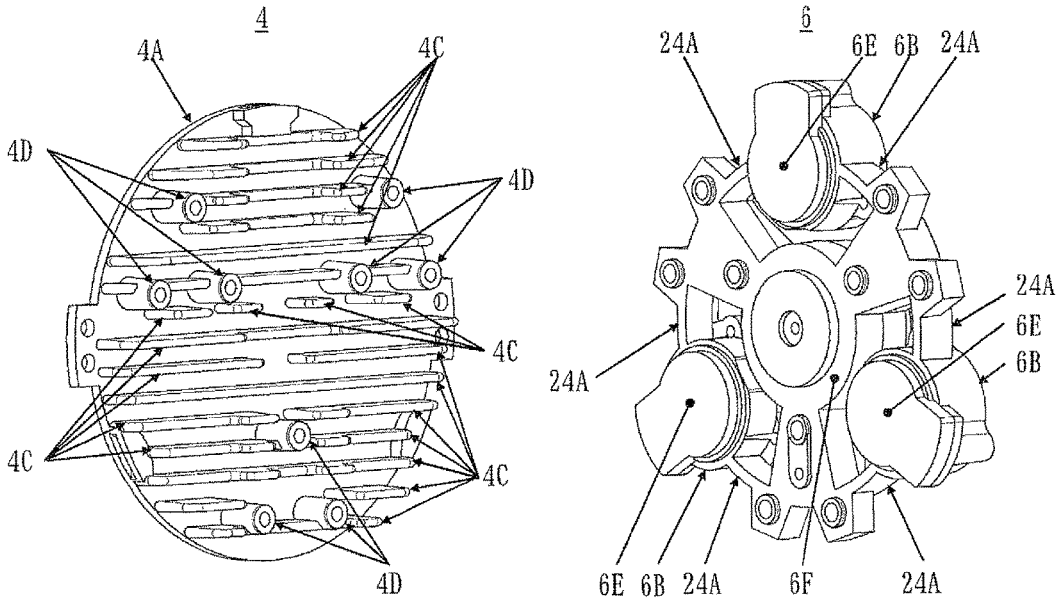
FIG. 4 is an exploded perspective view of an orbiting scroll and a boss plate part according to an embodiment of the present invention.

FIG. 3 shows orbiting scroll 4 according to the present embodiment, and FIG. 4 shows an exploded perspective view of orbiting scroll 4 and boss plate part 6 according to the present embodiment. The present embodiment was configured that spaces 24 were provided between drive shaft side boss plate part 6F where bearing boss part 6A of boss plate part 6 is located and rotation prevention mechanism side boss plate parts 6E where multiple bearing boss parts 6B are located, and rotation prevention mechanism side boss plate parts 6E and drive shaft side boss plate part 6F were not connected to each other in the radial direction. The multiple rotation prevention mechanism side boss plate parts 6E of boss plate part 6 are connected to drive shaft side boss plate part 6F through support parts 24A that connect each of rotation prevention mechanism side boss plate parts 6E to each other in a ring shape. When end plate 4A of orbiting scroll 4 deforms due to the thermal expansion by the compression operation, support part 24A is elastically deformed, thereby deformation of rotation prevention mechanism side boss plate parts 6E is absorbed, and generation of the dimension difference between the distance of bearing boss 6A from the center of end plate 3A and the distance of bearing boss 2D from the center of casing 2 can be suppressed. In a similar manner, deformation of bearing boss 6B and rotation prevention mechanism side boss plate parts 6E caused by the thermal expansion of boss plate part 6 itself can be absorbed by elastic deformation of support parts 24A, and generation of the dimension difference between the distance of bearing boss 6A from the center of end plate 3A and the distance of bearing boss 2D from the center of casing 2 can be suppressed.

According to the present embodiment, spaces 24 are formed on straight lines that connect the center part of boss plate part 6 (drive shaft side boss plate part 6F) and rotation prevention mechanism side boss plate parts 6E to each other. Therefore, even when boss plate part 6 thermally expands greatly with respect to casing 2 due to the effect of the heat generated in compression chambers 7, rotation prevention mechanism side boss plate parts 6E moves inward in the radial direction relatively to drive shaft side boss plate part 6F. Thus, the dimension difference between the distance of bearing boss 6A from the center of end plate 3A and the distance of bearing boss 2D from the center of casing 2 reduces, and an excessive load applied to rotation prevention mechanisms 17 and auxiliary crank bearings 20, 21 can be reduced.

Figure 5:
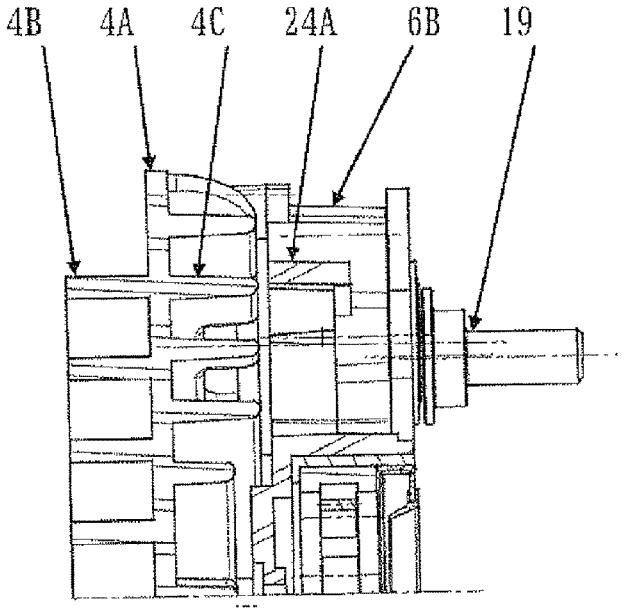
FIG. 5 is an enlarged view of an orbiting scroll according to an embodiment of the present invention.

The cross section of support part 24A is configured that the width in the axial direction parallel to drive shaft 10 is longer than the width in the radial direction as shown in FIG. 5, and is configured to facilitate elastic deformation in the radial direction while securing the stiffness in the axial direction for transmitting the gas force in the thrust direction.

Figure 6:
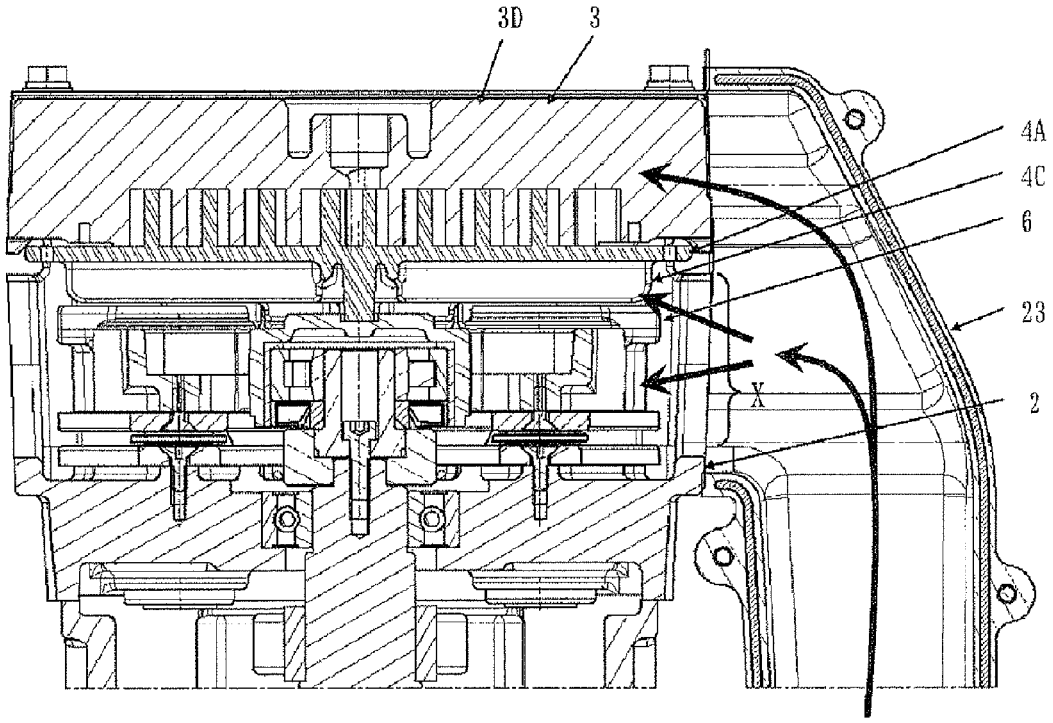
FIG. 6 is a transverse sectional view of an oil-free scroll compressor according to an embodiment of the present invention.

Here, cooling of the scroll-type compressor in the present embodiment will be explained using FIG. 6. The cooling wind generated by cooling fan 22 is guided to the side surface of casing 2 and stationary scroll 3 by wind guide duct 23, and is roughly divided into the orbiting scroll side cooling wind that flows in from a cooling wind inlet opening X of casing 2 and the stationary scroll side cooling wind that flows in from the side surface of stationary scroll 3.

The stationary scroll side cooling wind is discharged to the outside of the compressor body while cooling stationary scroll 3 while passing through the gaps of the cooing fins 3D.

The orbiting scroll side cooling wind is roughly divided into "fin gap flow" that passes between the multiple cooling fins 4C provided between end plate 4A and boss plate part 6 and provided so as to be parallel to the direction of the flow of the cooling wind and cools orbiting scroll 4, and "boss plate flow" that passes between casing 2 and boss plate part 6 and cools boss plate part 6.

Here, spaces 24 become ventilation holes for circulating the cooling wind, and "fin gap flow" that is the cooling wind on the orbiting scroll side and "boss plate flow" cross each other there. Thus, the cooling wind can be effectively introduced to bearing boss part 6A and bearing boss parts 6B shown in FIG. 4, therefore the temperature of the entire boss plate part 6 can be lowered, and the thermal expansion itself of boss plate part 6 can be reduced.

Also, according to the present embodiment, cooling fins 4C of orbiting scroll 4 and boss plate part 6 were made to be separated from each other. Thus, the thermal conduction from compression chambers 7 to boss plate part 6 can be suppressed, and the thermal expansion of boss plate part 6 can be reduced further.

Also, according to the present embodiment, as shown in FIGS. 3, 4, the contact portion of orbiting scroll 4 and boss plate part 6 was made to be only the periphery of fastening bolts 6D that fasten orbiting scroll 4 and boss plate part 6. Further, fastening bolts 6D were provided in drive shaft side boss plate part 6F or support parts 24A, and was configured not to contact rotation prevention mechanism side boss plate parts 6E. Thus, deformation caused by thermal expansion of end plate 4A of orbiting scroll 4 is hardly transferred to rotation prevention mechanism side boss plate parts 6E, the load applied to rotation prevention mechanisms 17 and auxiliary crank bearings 20, 21 can be reduced further. Also, the thermal conduction from compression chambers 7 to auxiliary crank bearing 20 is suppressed, the temperature of the auxiliary crank bearing 21 is lowered, and reliability of the bearings can be improved without extremely accelerating deterioration of the lubricant.

From the above, according to the present embodiment, by providing spaces 24 between drive shaft side boss plate part 6F where bearing boss part 6A of boss plate part 6 is located and rotation prevention mechanism side boss plate parts 6E where bearing boss parts 6B are located, even when boss plate part 6 thermally expands, the dimension difference between the distance of bearing boss 6A from the center of end plate 3A and the distance of bearing boss 2D from the center of casing 2 reduces, and the load applied to rotation prevention mechanisms 17 and auxiliary crank bearings 20, 21 can be reduced.

Also, by making the spaces the ventilation holes, the cooling efficiency of each portion of boss plate part 6 is improved and the temperature of boss plate part 6 is lowered, thereby the thermal expansion itself of boss plate part 6 can be suppressed, and the load applied to rotation prevention mechanisms 17 and auxiliary crank bearings 20, 21 can be reduced further. Also, the temperature of turning bearing 13 and the auxiliary crank bearing 21 stored in the respective bearing bosses is lowered, and reliability of the bearings can be improved without extremely accelerating deterioration of the lubricant.

Any of the embodiments described so far only shows an example of materialization in implementing the present invention, and the technical range of the present invention is not to be interpreted determinatively by them. To be more specific, the present invention can be implemented in various forms without departing from the technical thought thereof or the main characteristics thereof.

REFERENCE SIGNS LIST

1: Compressor body
2: Casing
2A: Cylindrical part
2B: Bottom part
2C: Attaching part
2D: Bearing boss
3: Stationary scroll (scroll member)
3A: End plate
3B: Lap part
3C: Support part
3D: Cooling fin
4: Orbiting scroll
4A: End plate
4B: Lap part
4C: Cooling fin
4D: Fastening part
5: Motor
5A, 5B: Bearing
6: Boss plate part
6A: Bearing boss (turning bearing)
6B: Bearing boss (auxiliary crank bearing)
6C: Fastening part (boss plate)
6D: Fastening bolt
6E: Rotation prevention mechanism side boss plate part
6F: Drive shaft side boss plate part
7: Compression chamber
8: Suction port
8A: Intake filter
9: Discharge port
10: Drive shaft
11: Crank part
12: Balance weight
13: Turning bearing
17: Rotation prevention mechanism
19: Auxiliary crank
20: Auxiliary crank bearing (casing side)
21: Auxiliary crank bearing (orbiting scroll side)
22: Cooling fin
23: Wind guide duct
24: Space
24A: Support part

The invention claimed is:

1. A scroll-type fluid machine, comprising:
a stationary scroll;
an orbiting scroll that is provided opposing the stationary scroll and undergoes turning movement;
a casing provided on the outside of the orbiting scroll;
a drive shaft that drives and turns the orbiting scroll;
a boss plate part that is provided separated from the orbiting scroll and is connected to the drive shaft; and
a plurality of rotation prevention mechanisms provided between the boss plate part and the casing, wherein
the boss plate part includes a plurality of rotation prevention mechanism-side boss plate parts connected to the rotation prevention mechanisms and a drive shaft-side boss plate part connected to the drive shaft,
the boss plate part defines through holes that are provided immediately adjacent to: i) the rotation prevention mechanism-side boss plate parts, and ii) the drive shaft-side boss plate part, the through holes defining pairs of adjacent through holes in a circumferential direction of the boss plate part, and
arranged between each pair of adjacent through holes, along a radial direction of the boss plate part, there are three openings configured to receive fasteners, the three openings being arranged so as to define vertices of a triangle.

2. The scroll-type fluid machine according to claim 1, wherein cooling wind passes through the through holes.

3. The scroll-type fluid machine according to claim 1, wherein the through holes are formed at least on straight lines that connect the center part of the boss plate part and the center parts of the rotation prevention mechanisms.

4. The scroll-type fluid machine according to claim 1, wherein cooling fins are provided in the orbiting scroll, and the cooling fins and the boss plate part are separated from each other.

5. The scroll-type fluid machine according to claim 1, wherein the plurality of the rotation prevention mechanism side boss plate parts are connected to each other by support parts, and the support parts and the drive shaft side boss plate part are connected to each other.

6. The scroll-type fluid machine according to claim 5, wherein fastening parts that fasten the boss plate part and the orbiting scroll with each other are provided in the support part or the drive shaft side boss plate part, and are not provided in the rotation prevention mechanism side boss plate parts.

7. The scroll-type fluid machine according to claim 5, wherein the dimension in the drive shaft direction of the support parts is longer than the dimension in the radial direction of the support parts.

8. A scroll-type fluid machine, comprising:
a stationary scroll;

an orbiting scroll that is provided opposing the stationary scroll and undergoes turning movement;

a drive shaft that drives and turns the orbiting scroll;

a boss plate part that is provided separated from the orbiting scroll and is connected to the drive shaft; and a plurality of rotation prevention mechanisms that prevent the orbiting scroll from rotating, wherein the boss plate part includes a plurality of rotation prevention mechanism-side boss plate parts connected to the rotation prevention mechanisms and a drive shaft-side boss plate part connected to the drive shaft, the rotation prevention mechanism-side boss plate parts and the drive shaft-side boss plate part are not connected to each other in a radial direction of the boss plate part, the boss plate part defines through holes that are provided immediately adjacent to: i) the rotation prevention mechanism-side boss plate parts, and ii) the drive shaft-side boss plate part, the through holes defining pairs of adjacent through holes in a circumferential direction of the boss plate part, and arranged between each pair of adjacent through holes, along the radial direction of the boss plate part, there are three openings configured to receive fasteners, the three openings being arranged so as to define vertices of a triangle.

9. The scroll-type fluid machine according to claim 8, wherein the through holes between the rotation prevention mechanism-side boss plate parts and the drive shaft-side boss plate part are ventilation holes through which cooling wind passes.

10. The scroll-type fluid machine according to claim 9, wherein at least through holes on straight lines that connect the center part of the boss plate part and the center parts of the rotation prevention mechanisms to each other are the ventilation holes.

11. The scroll-type fluid machine according to claim 8, wherein cooling fins are provided in the orbiting scroll, and the cooling fins and the boss plate part are separated from each other.

12. The scroll-type fluid machine according to claim 8, wherein the boss plate part includes support parts that connect the plurality of the rotation prevention mechanism-side boss plate parts to each other, and the support parts and the drive shaft-side boss plate part are connected to each other.

13. The scroll-type fluid machine according to claim 12, wherein fastening parts that fasten the boss plate part and the orbiting scroll with each other are provided in the support part or the drive shaft side boss plate part, and the fastening parts are not provided in the rotation prevention mechanism side boss plate parts.

14. The scroll-type fluid machine according to claim 12, wherein the dimension in the drive shaft direction of the support parts is longer than the dimension in the radial direction of the support parts.

* * * * *